US005121520A

United States Patent [19]

Brice

[11] Patent Number: 5,121,520

[45] Date of Patent: Jun. 16, 1992

[54] TWIN-HEADED TOOTHBRUSH

[75] Inventor: Michael F. Brice, Syosset, N.Y.

[73] Assignee: Inter-X Scientific, Inc., Syosset, N.Y.

[21] Appl. No.: 556,519

[22] Filed: Jul. 24, 1990

[51] Int. Cl.[5] ..... A46B 9/04

[52] U.S. Cl. ..... 15/167.1; 15/167.2; 15/172; D4/105

[58] Field of Search ..... 15/167.1, 167.2, 167.3, 15/160, 172; D4/104, 105, 119

[56] References Cited

U.S. PATENT DOCUMENTS

| | | | |
|---|---|---|---|
| 18,653 | 11/1857 | Wadsworth | 15/167.1 |
| 860,840 | 7/1907 | Strassburger | 15/167.1 |
| 1,565,750 | 12/1925 | Nathanson | 15/167.2 |
| 1,668,216 | 5/1928 | Noel | 15/167.1 |
| 1,679,785 | 8/1928 | Quinn | 15/167.1 |
| 1,868,368 | 7/1932 | Reese | 15/167.2 |
| 1,928,328 | 9/1933 | Carpentier | 15/167.1 |
| 2,164,219 | 6/1937 | McGerry | 15/167.1 |
| 2,242,743 | 5/1941 | Brown | 15/167.1 |
| 2,266,195 | 12/1941 | Hallock | 15/167.1 |
| 3,129,449 | 4/1964 | Cyzer | 15/167.1 |
| 3,152,349 | 10/1964 | Brennesholtz | 15/167.1 |
| 3,193,864 | 7/1965 | Makowsky | 15/167.1 |
| 3,350,737 | 11/1967 | Makowsky | 15/167.1 |
| 3,691,587 | 9/1972 | Makowsky | 15/167.1 |
| 3,742,549 | 7/1973 | Scopp et al. | 15/167.1 |
| 4,333,199 | 10/1982 | Del Rosario | 15/167.1 |
| 4,403,623 | 9/1983 | Mark | 15/167.1 |
| 4,449,266 | 5/1984 | Northemann et al. | 15/167.2 |
| 4,472,853 | 9/1984 | Rauch | 15/167.1 |
| 4,488,328 | 12/1984 | Hyman | 15/167.1 |
| 4,638,520 | 1/1987 | Eickmann | 15/167.2 |
| 4,667,360 | 3/1987 | Marthaler et al. | 15/167.1 |
| 4,691,405 | 9/1987 | Reed | 15/167.1 |
| 4,776,054 | 10/1988 | Rauch | 15/167.1 |
| 4,876,157 | 10/1989 | Bormon | 15/167.2 |

FOREIGN PATENT DOCUMENTS

| | | | |
|---|---|---|---|
| 818794 | 5/1952 | Fed. Rep. of Germany | 15/167.2 |
| 642976 | 9/1928 | France | 15/167.1 |
| 594027 | 5/1959 | Italy | 15/167.2 |

*Primary Examiner*—Harvey C. Hornsby
*Assistant Examiner*—Gary K. Graham
*Attorney, Agent, or Firm*—Pennie & Edmonds

[57] ABSTRACT

A new and improved toothbrush has a pair of discreet twin brushing heads. Each head is attached to the handle portion at a predetermined angle relative to the handle portion. The heads are arranged in a side-by-side manner with the angle of the heads tilted in the opposite directions relative to the handle portion. In one embodiment, the heads are fixed relative to the handle portion. In another embodiment, the heads are fixed relative to a handle portion, but the handle portion flexes when sufficient pressure is applied to the brushing heads during brushing. In still another embodiment, each head pivots independently of the other head about a base head which is attached to the handle portion. One unique aspect about the twin-headed toothbrush is that the toothbrush is specifically designed to be used with the conventional brushing technique that the majority of the people are accustomed to, but provide an effective cleaning of teeth and gum surfaces.

20 Claims, 7 Drawing Sheets

TWIN-HEADED TOOTHBRUSH

BACKGROUND OF THE INVENTION

1. Field of the Invention

This invention relates to a new and improved toothbrush having side-by-side arranged brushing heads angled in the opposite directions with respect to each other.

2. Description of the Prior Invention

In order to effectively clean teeth and gum areas, complex maneuvering of a toothbrush is necessary. It is generally acknowledged that the great majority of individuals brush their teeth and gum surfaces primarily in a horizontal and semi-circular manner, even though this particular technique is not the most effective way of cleaning the teeth and gum surfaces. There are two reasons why most individuals resort to this ineffective technique. First, conventional brushing heads are not particularly designed to follow the contours of the teeth and gum surfaces, and as an extension of the human arm do not permit complicated and exact maneuvers to be performed. Second, most brushing takes place in the early morning when one first arises and in the evening just prior to retiring. This is a key factor, as demanding complicated procedures for this time of day and night are beyond the tolerance of most individuals. For these reasons, most individuals resort to a simple natural horizontal or semi-circular conventional brushing technique.

Numerous attempts have been made in the past as shown, for example, in U.S. Pat. Nos. 860,840 to Strassburger, 3,742,549 to Scopp et al., and 4,667,360 to Marthaler et al to improve the design of the toothbrush. The bristles and/or head of these prior inventions are angled relative to the handle portion. More particularly, U.S. Pat. No. 860,840 to Strassburger discloses a toothbrush having two rows of bristles which are sloped in opposite directions relative to each other and a central section of bristles arranged parallel and located between the two outside rows. In contrast to the prior art, the outside rows of the present invention have equal length bristles throughout the brushing heads to provide lateral support across the entire width of the toothbrush heads. Moreover, these prior inventions do not provide the pair of discreet, side-by-side arranged, brushing heads of the present invention.

In other prior art patents, adjacent head portions of a toothbrush are made to pivot or flex relative to the handle portion so that the bristles are better able to conform to the contours of the teeth and gum surfaces. Such an arrangement is shown in U.S. Pat. Nos. 1,928,328 to Carpentier, 2,266,195 to Hallock, 3,152,349 to Brennesholtz, 4,333,199 to Del Rosario, 4,488,328 to Hyman, 4,691,405 to Reed, and 4,776,054 to Rauch. More particularly, U.S. Pat. Nos. 4,333,199 to Del Rosario and 4,488,328 to Hyman disclose a toothbrush having a single discreet brushing head that can be pivoted about the handle. The Del Rosario patent, in addition, discloses a brushing head that can rotate about three planes. In contrast, the present invention provides discreet, strategically positional brushing heads as opposed to a single brushing head taught by these prior inventions.

U.S. Pat. Nos. 1,928,328 to Carpentier, 2,266,195 to Hallock 3,152,349 to Brennesholtz and 4,691,405 to Reed show a toothbrush head capable of flexing or articulating relative to the handle. Specifically, the brushing head comprises a plurality of serially arranged flexing head segments, whereby the segments flex in unison or relative to each other. In contrast, the brushing heads of the present invention are arranged side-by-side as opposed to the serially arranged head segments of these prior inventions. Furthermore, the unique angularly arranged heads of the present invention provide a plurality of discreet stabilizing contact areas to prevent excess pressure build-up and possible gum damage that can occur on a single concentrated point on the gum.

Finally, U.S. Pat. No. 4,776,054 to Rauch discloses a toothbrush head having three arranged brushing segments. However, the segments are not discreet brushing heads in contrast to the uniquely arranged discreet brushing heads of the present invention. Even if the segments are considered as discreet heads, because the central segment is aligned with the handle and the two segments on either side are symmetrically arranged relative to the central head, the Rauch patent does not show or disclose the present invention which comprises two side-by-side arranged heads inclined in the opposite directions relative to each other. Moreover, the Rauch patent does not provide a plurality of stabilizing areas as is provided in the present invention for safely and stably resting and positioning the brushing heads on the teeth and the gum surfaces. Instead, the bristles on the outer sides of the Rauch patent have narrow, blade-like, contact points which are likely to induce excessive pressure to the gum due to the narrow contact points. In other words, the narrow blade-like bristles inherently place higher excessive concentrated pressure on the gum more so than bristles with a larger contact area which can spread pressure evenly to the larger contact area.

In addition to the above discussed distinguishing features, none of the prior art toothbrushes are directed to overcoming ineffective brushing techniques. These prior inventions do not disclose a toothbrush that overcomes the individual's anatomically limited abilities to effectively clean the curvilinear surfaces of the teeth and provide for gentle stimulation of the varying gum tissues without harm or discomfort for the user by utilizing side-by-side arranged brushing heads having cleaning surface areas in oppositely angled planes.

SUMMARY OF THE INVENTION

The present invention provides a toothbrush that addresses the anatomic reality of the individual user's limited ability to achieve complex brushing requirements whether in a fully sensory conscious cognitive state or in an effected tiredness state and/or limited cognitive conscious ability. Specifically, the invention provides two side-by-side arranged discreet brushing heads with the heads angled in opposed directions relative to the handle portion of the toothbrush. These two discreet heads represent an angled configuration complimentary to the brushing surfaces encountered in typical human teeth and gum areas. The particular orientation of the present toothbrush is designed to ensure that the brushing heads follow the contours of the gum and teeth surfaces with a primary objective of reaching and making contact with all dental surfaces, including the inter-dental regions.

In addition, the brushing heads of the present invention are provided with two discreet stabilizing contact areas, these contact areas being the respective "high"

areas of the two brushing heads that initially meet the teeth and gum surfaces. A critical aspect of the invention, which is not shown by any of the prior art, is that the side-by-side arranged brushing heads enable stable brushing strokes by providing stabilizing contact areas. This is especially so during brushing of the molars, which have irregular and nonlinear surfaces. In other words, the two contact areas of the present invention provide a much better stable footing for the brush heads than the single contact area provided by the prior art brushes. Specifically, in the Marthaler patent, the toothbrush concentrates the pressure applied by the user to a singular point on the brushing surfaces. Consequently, excessive concentrated pressure is applied to the surface encountered during brushing, causing wear and/or deformation of that surface. Additionally, this excessive concentrated pressure can abrade the gum surfaces, causing undue discomfort to the user. These disadvantages are overcome by the present design.

Further, while conventional toothbrushes merely skim over the inter-dental regions, the twin heads of the present invention results in a purposeful stopping/pausing action, allowing the user to experience a momentary "fixing" or adaptation of the brushing head on the individual tooth and the respective gum areas encountered therein without excessive concentrated pressure to a singular region. Hence, the special configuration of the present toothbrush interrupts the conventional brushing technique with the brushing stroke "wanting" to pause on the individual tooth and respective gum areas encountered and thereby allows the user to momentarily concentrate on an individual tooth and a respective gum surface without excessive pressure to a singular point. Significantly, this pausing action does not require the user to understand and effect a new brushing technique. The novel brushing heads of the present invention automatically guide the brushing heads to follow each and every tooth and the respective gum surfaces in a way not achieved by the prior art.

Moreover, it should be noted that human dental structure consists of a large variety of different types of surfaces. One type is a substantially flat surface existing on the faces of the upper and lower front teeth. Even in these flat faces, there are closely aligned inter-dental regions which are frequently neglected during brushing simply because the conventional toothbrushes cannot effectively reach these inter-dental surfaces. As one progresses towards the back of the mouth, one encounters radically different teeth surfaces, principally the irregular surfaces of the molars of the top and bottom teeth. When brushing the molar regions, individuals generally brush with a somewhat diagonal backwards and forwards brushing angle. The present toothbrush is particularly useful and uniquely designed to effectively contact and clean the molar regions. The opposing high and low planes of the brushing heads of the present invention contact the peaks and valleys of the individual molars especially with a diagonally directed backward and forward brushing motion.

In addition, the opposing planes of the brushing heads of the present invention create a natural "upward and over" movement when brushing the lower molar regions, and a mirror imaged "downward and over" movement when brushing the upper molar regions. This "upward and over" movement can be basically described as an arc in the shape of an inverted-U. Specifically, the brushing heads start by brushing the outer vertical dental surfaces of the lower molars with conventional brushing strokes, i.e., back and forth movement across the lower outer molar surfaces. The brushing heads are then simultaneously shifted upward and to about 45 degrees, while continuously imparting the back and forth brushing strokes, to contact the curved outer surfaces at the junction of the outer surfaces and the uppermost surfaces of the lower molars. While continuously imparting the back and forth brushing strokes, the brushing heads are shifted directly onto the uppermost surfaces of the lower molars and then again shifted over and at about 45 degrees to the inner curved surfaces where the uppermost surfaces and the inner vertical surfaces of the lower molars meet. The brushing heads are shifted, once again, to complete the inverted-U arc, to contact the inner vertical surfaces of the lower molars while continuously imparting the back and forth brushing strokes. This inverted-U arcing motion is then repeated in the reverse order until the user is satisfied that the molars have been cleaned. The "downward and over" movement can be described as an arc in the shape of U, this motion being the mirror image of the "upward and over" movement. Therefore, it is not deemed necessary to describe the "downward and over" movement in detail.

Individuals attempting to provide these "upward and over" and "downward and over" movements using a conventional "flat" headed toothbrush having a single contact plane can only attain limited success due to the constraint resulting from the single plane construction. In other words, a toothbrush with a single resting surface on the teeth and gum surfaces does not provide stable contact support to enable stable brushing strokes to be imparted to the molar surfaces. When attempting to brush the irregular and curved surfaces of the molars with a conventional toothbrush, the brushing head tends to slip off the irregular surfaces of the molars or wobble randomly about the single contact area, since the single contact surface acts as a pivot.

On the other hand, the present brushing heads are strategically situated relative to each other to provide two opposed contact planes and thus two resting surfaces on adjacently situated different planes. Because of these uniquely situated brushing heads, wobble and slipping are eliminated. Accordingly, during brushing of the curved and irregular surfaces, the two resting surfaces provide a stable footing which enables stable brushing strokes to be imparted on any desired surfaces to be brushed without the brushing head slipping or randomly wobbling thereabout. All "upward and over" and "downward and over" maneuvering when using a conventional "flat-headed" toothbrush are done on a random, haphazard basis that results from somewhat unconscious movement on the part of the user necessary to access all the surfaces of the molars. On the other hand, the two side-by-side opposing brushing head planes of the toothbrush of this invention are specifically designed to automatically guide the "upward and over" and "downward and over" movements when brushing the molar regions.

Moreover, the resistance created by the opposing planes of the brushing heads of the present toothbrush, as the bristles contact the varying tooth surfaces and the interdental regions therebetween, is transmitted back to the user purely through sensory feeling in the hand and arm of the user. This resistance enables the user to adjust the pressing force needed to scrub the areas being brushed without resulting in undue pressure and/or injury to the gum.

In one embodiment of the present toothbrush, the side-by-side arranged heads, although fixed relative to the handle portion of the toothbrush, are capable of flexing. In another embodiment, the brushing heads are independently articulated about a base of the toothbrush which is fixed to the handle portion to enable the heads to resiliently follow the contours of the teeth and gum surfaces without damaging the gum. During brushing, the articulated brushing heads move to the differing surfaces encountered, including the side, inside, and top and respective bottom areas of the individual teeth and adjacent gum areas. Further, the distance between the two respective high points of the present dual brushing heads can be varied to accommodate different widths or sizes of teeth. For instance, a child version of my toothbrush would have closer opposite high points while adult versions would have various distances to accommodate the needs of all adults.

Accordingly, an object of the invention is to provide an improved cleaning instrument for cleaning teeth and stimulating gum surfaces that is specifically designed, addresses, and accepts the reality that most individuals brush their teeth and gum surfaces with a conventional technique determined by the imposed limited anatomical nature of a brushing device as an extension of the human arm.

Another object of the invention is to provide a toothbrush that contacts all the dental regions encountered within the mouth, especially the inter-dental regions.

Another object of the invention is to provide a toothbrush that stimulates the gum/gingival tissue areas while at the same time effectively cleaning the teeth and gum surfaces using a conventional technique.

Another object of the invention is to provide a toothbrush with two stabilizing points while brushing, the two points being the respective high areas of the two brushing heads.

Another object of the invention is to provide a toothbrush that effectuates a purposeful stopping/pausing action to allow the user to experience a momentary "fixing" of the brush heads on the individual tooth and gum areas.

Another object of the invention is to provide a toothbrush with twin heads, whereby each head is resiliently fixed at a predetermined angle relative to the handle portion, and the heads are positioned in the opposite angles relative to the handle portion.

Yet another object of the invention is to provide a toothbrush with twin heads, whereby each head is articulated about a base portion which is fixed to the handle portion, and the heads are positioned in the opposite angles relative to the handle portion.

The foregoing invention and features and advantages of my invention will be better appreciated from the following description.

DETAILED DESCRIPTION OF THE PREFERRED EMBODIMENT

Figure 1:
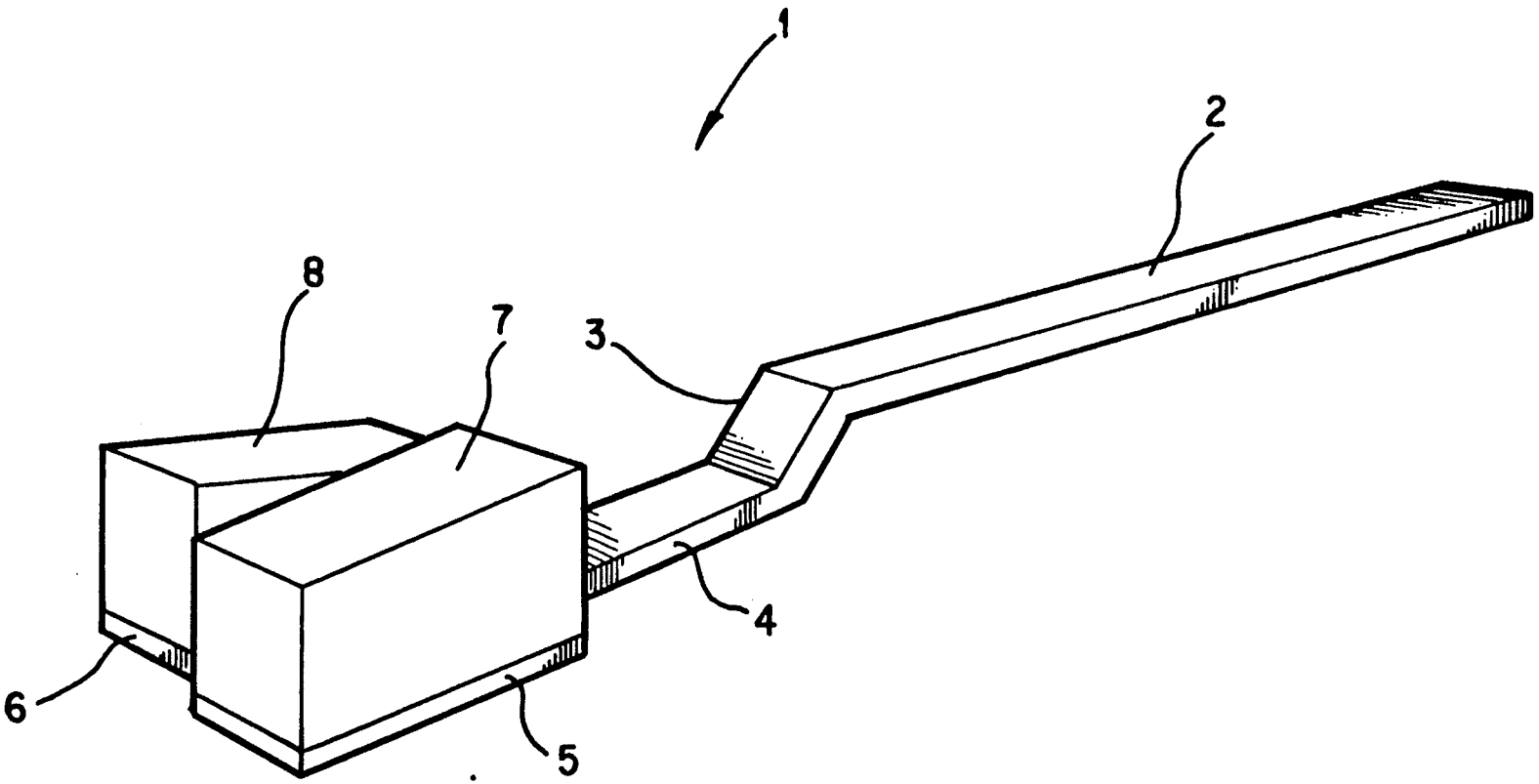
FIG. 1 is a perspective view of a dual-headed toothbrush in which the heads are fixed respect to the handle according to a first embodiment of the invention.
Figure 2:
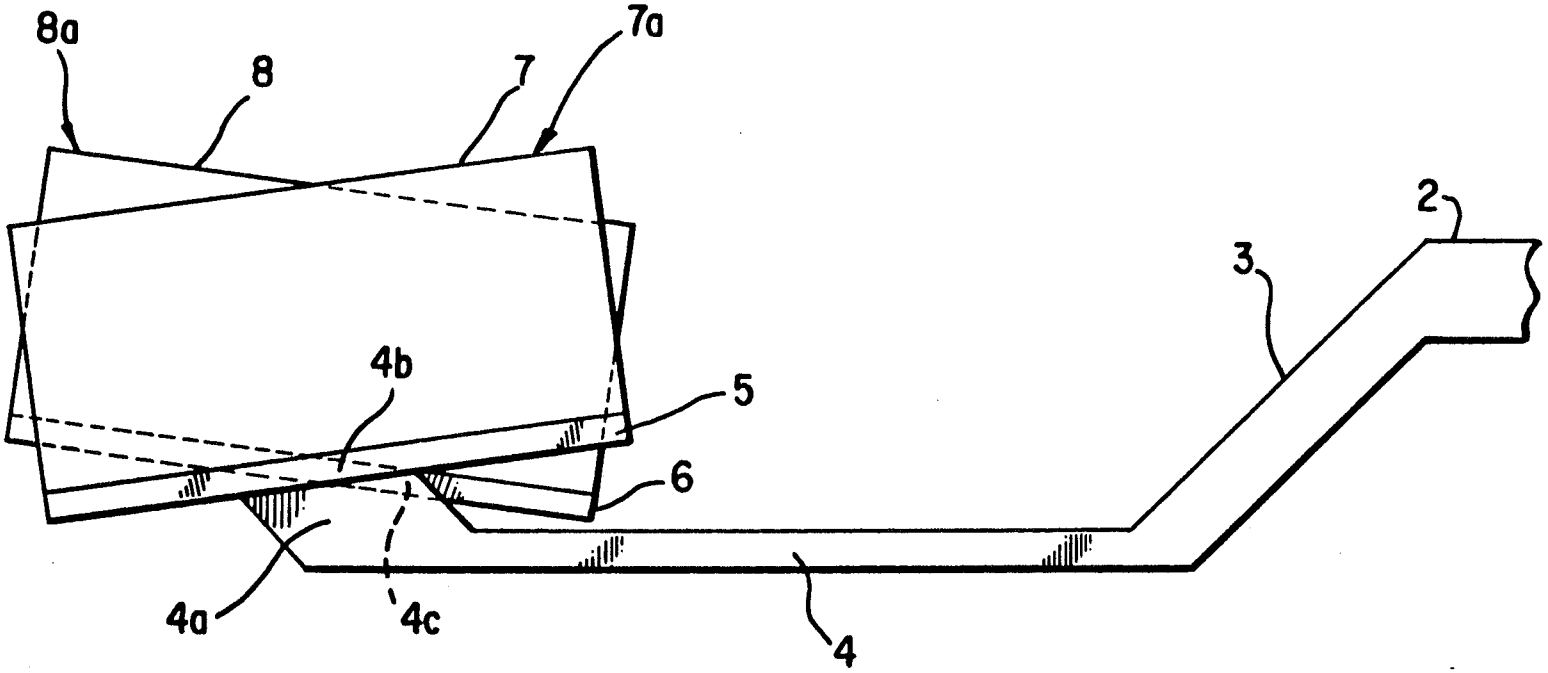
FIG. 2 is a side view of the fixed toothbrush of FIG. 1.
Figure 3:
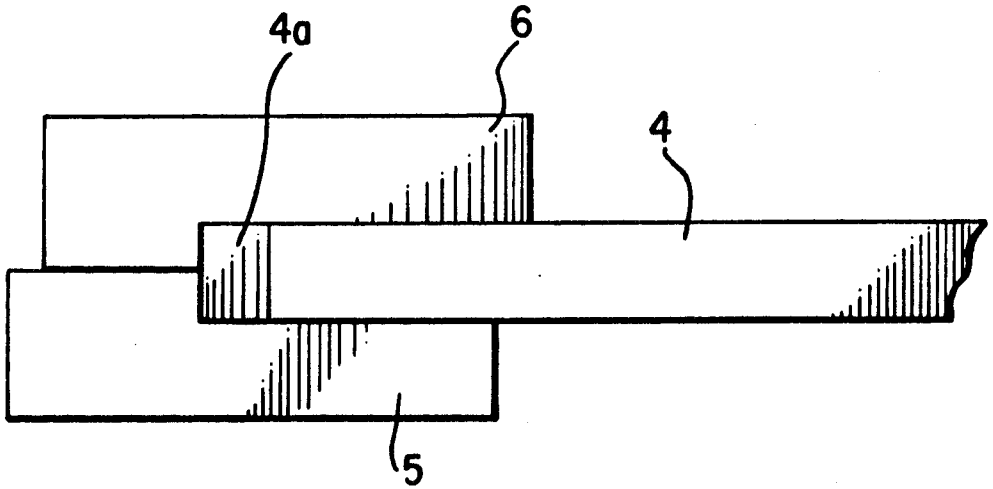
FIG. 3 is a bottom view of the fixed toothbrush of FIG. 1.

FIGS. 1—3 show a first embodiment of the dual-headed toothbrush (1) of the present invention. In this embodiment, brushing heads (5,6) are either integrally made with a base member (**4*a*), as shown in FIG. 2 or made separately and then attached to the base member by any conventional attaching method such as fusing, gluing, etc. The base member is integral with a neck portion (4) which in turn is integral with an offset portion (3) which in turn is integral with the handle (2**). The neck portion is made rigid or to flex by having the neck portion made of material capable of flexing when made with a relatively small cross sectional area in relation to the handle. Thus, when pressure is applied to the brushing heads while brushing teeth and gum surfaces, the neck portion flexes in response to the pressure applied during normal brushing and thereby allows for excessive pressure exerted by the user to be transmitted back to the user. The user can then on his/her accord ease-up on the pressure force being exerted.

FIG. 2 shows a side view of the first embodiment with a base member (**4*a*) clearly shown. The base member is made with two sloping portions (4*b*, 4*c*) which are sloped in the opposite directions in relation to the neck portion and the handle. Each head is fixed to a respective sloping portion of the base by a conventional attaching method as previously noted. FIG. 3 shows the two distinct brushing heads as shown from the bottom view. In this embodiment, because the heads are angled and fixed relative to the base, each head forms a high contact area and a low contact area. The two respective high areas (7*a*, 8*a***) of the brushing heads form the stabilizing contact areas which provide stable positioning and resting places for the brushing heads as previously discussed in detail.

Figure 4:
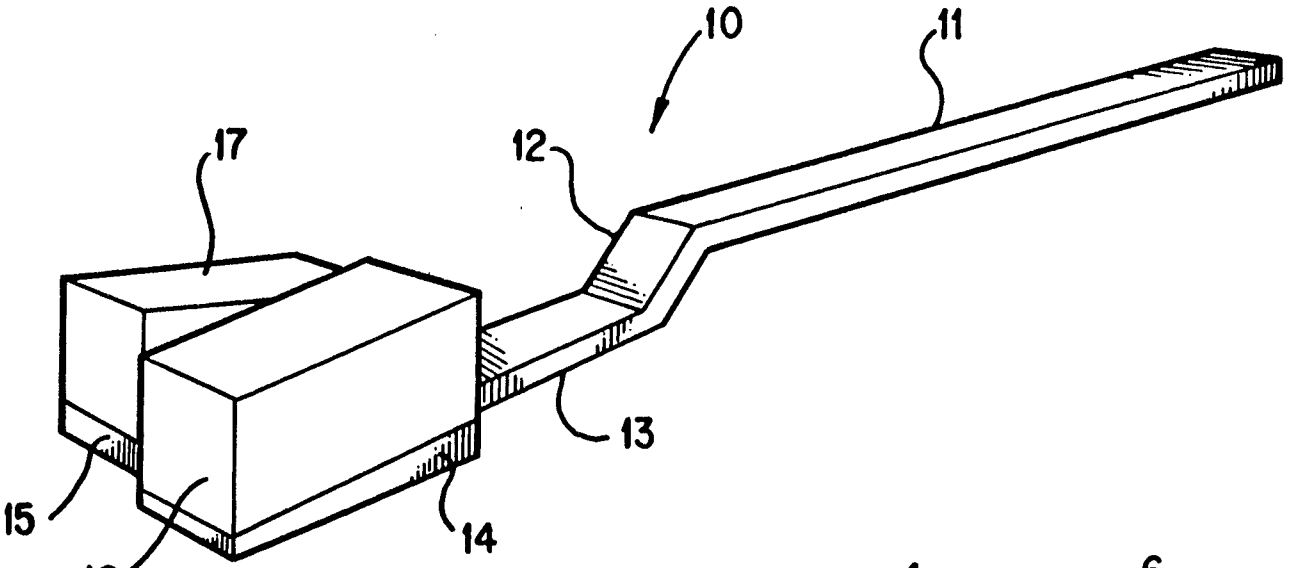
FIG. 4 is a perspective view of a fixed dual-headed toothbrush according to a second embodiment of the invention.
Figure 5:
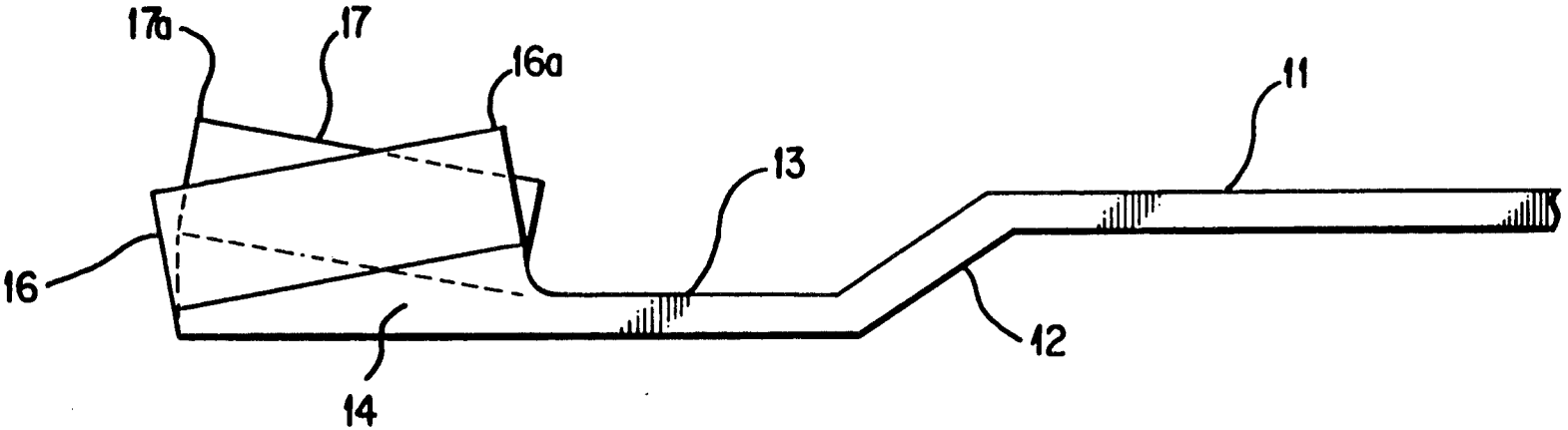
FIG. 5 is a side view of the second embodiment of the fixed toothbrush of FIG. 4.
Figure 6:
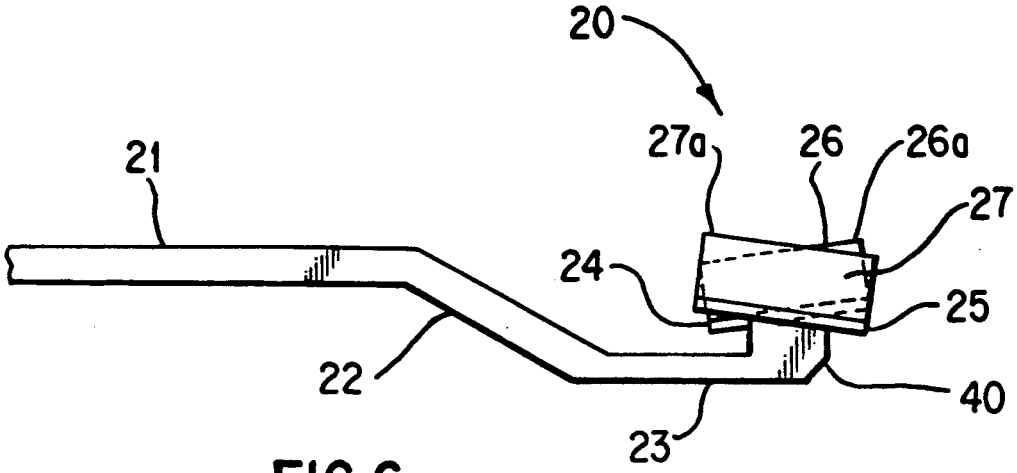
FIG. 6 is a side view of an articulating dual-headed toothbrush according to a third embodiment of the invention.

FIGS. 4 and 5 show a second embodiment of a dual-headed toothbrush (10). In this embodiment, the heads (14, 15) are integrally formed with or directly attached by using a conventional attaching method, as previously noted above, to a neck portion (13). The neck portion (13) is integral with an offset portion (12), and the offset portion (13) is in turn integral with the handle (11) in a manner similar to that as shown in the first embodiment in FIGS. 1-3. The heads (14, 15) are sloped in opposite directions in relation to the neck portion and the handle. Also, similar to the first embodiment, the neck portion is designed to flex when pressure is applied to the heads while brushing the teeth and gum surfaces as previously discussed above. The two stabilizing points (**16*a*, 17*a***) are formed in a manner similar to that as previously shown and discussed above in the first embodiment.

FIGS. 6-9 show a third embodiment of a dual-headed toothbrush (20). However, unlike the other two embodiments, brushing heads (24, 25) are articulated to a base (40), which is fixed to a neck portion (23), rather than being fixed as in the other two embodiments. In common with the other two embodiments, the neck portion (23) is designed to flex or be rigid. As shown, the handle (21), offset portion (22), and the neck portion (23) are integrally formed as in the other two embodiments.

Figure 7:
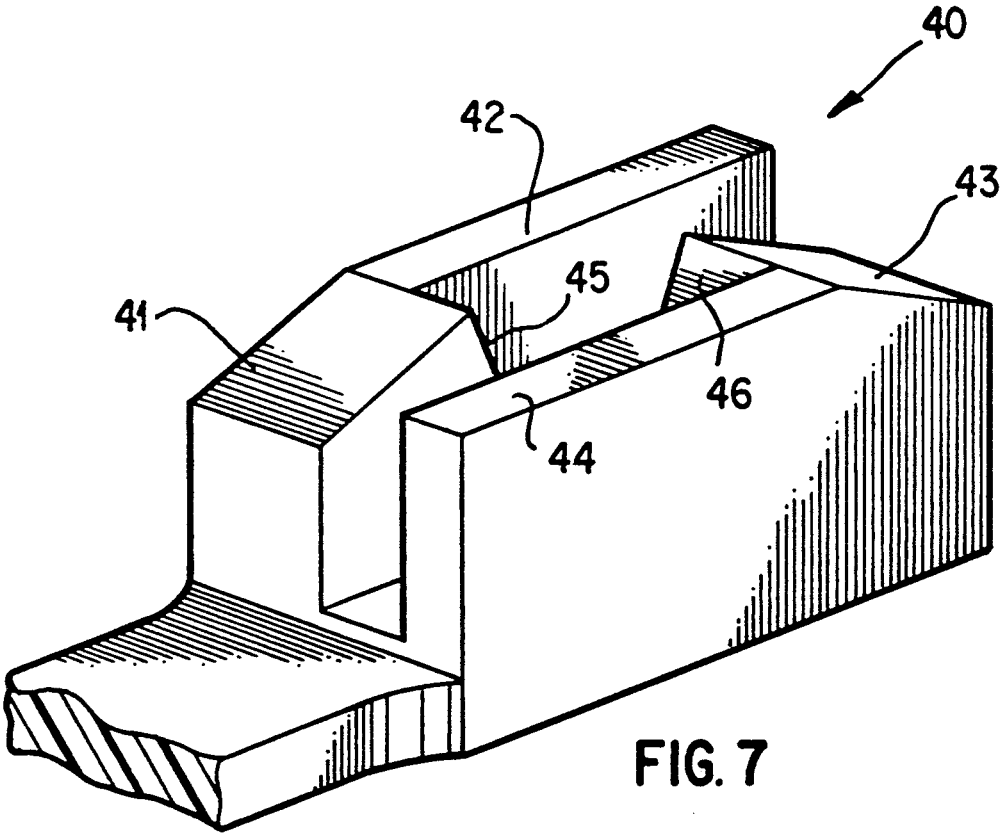
FIG. 7 is a perspective view of a base for the two heads according to the third embodiment.

FIG. 7 shows a detailed perspective view of the base (40) with the brushing heads removed. As better shown in the top view of the base (40) in FIG. 8 and sectional view in FIG. 9, the brushing heads (24, 25) are biased by springs (49) to engage resting surfaces (41, 43) when no external pressure is applied to the brushing heads. Stop surfaces (42, 44) act to limit the pivoting movement of the brushing heads. In other words, each brushing head pivots about the spring between the respective two surfaces (41 and 42 or 43 and 44) with the surfaces acting as limits. Moreover, each brushing head pivots within the limits independently of the other and each head pivots only when a predetermined pressure is applied to the brushing head.

The rest surfaces (41, 43) are oppositely angled relative to the neck portion. Similarly, the stop surfaces (42, 44) are oppositely angled. In this embodiment, the initial contact areas or "high points" of both separate brushing heads continually respond to the changing contours of the teeth and gum surfaces encountered during brushing. Between the rest surfaces (41, 43) and the stop surfaces, (42, 44), a channel (50) having a central transverse opening (51) and oppositely extending longitudinal openings (52, 53) at the ends of the central opening (in the shape of U with one of the U-legs inverted) are formed, as more clearly shown in FIG. 8. The central transverse opening (51) of the channel (50) is formed by opposing sloping walls (45, 46). From each of these sloping walls, a spring (49) extends outwardly into the oppositely extending longitudinal openings (52, 53) of the channel (50).

Figure 8:
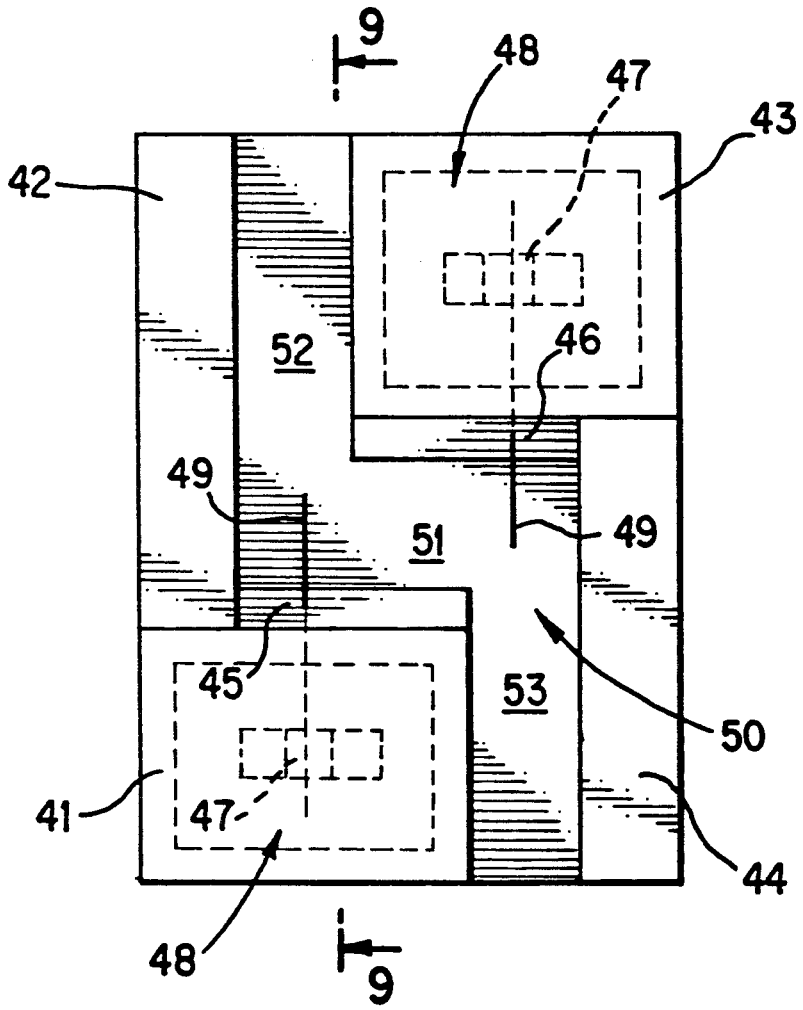
FIG. 8 is a top view of the base according to the third embodiment.

FIG. 8 shows a top view of the base (40) with the springs (49) extending into the channel (50). Each rest surface (41 or 43) is formed with a cavity (48) which has a post (47) extending into the cavity from the underside of the rest surfaces, as shown more clearly in FIG. 9. The post (47) accommodates and supports the spring (49) in a manner as shown more clearly in FIG. 9.

Figure 9:
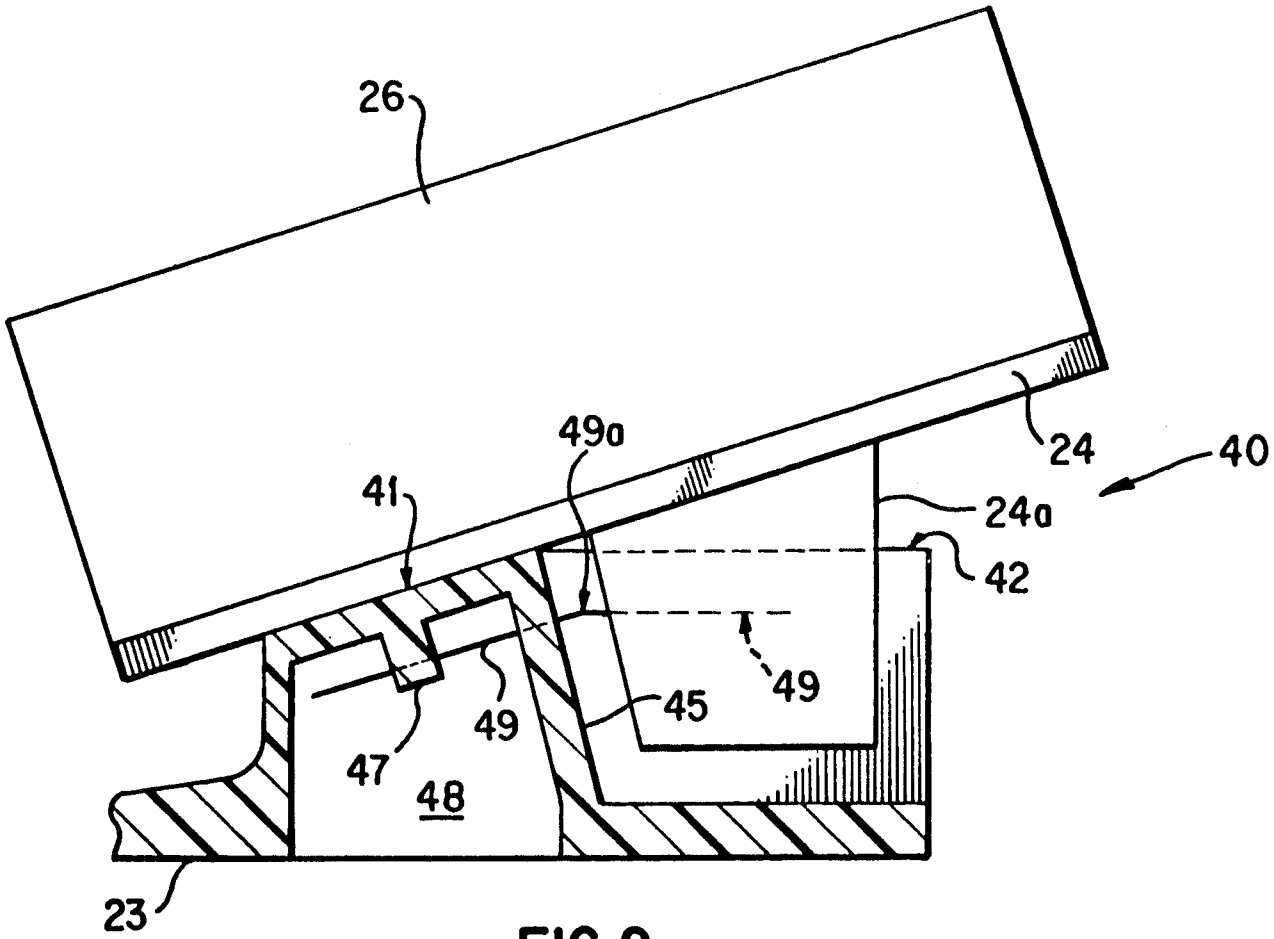
FIG. 9 is a cross-sectional view of the base showing a cavity according to the third embodiment as indicated by 9—9 in FIG. 8.

FIG. 9 is a cut-away view taken along the line 9—9 of FIG. 8, but showing a brushing head (24) installed in the head. Note that the other brushing head (25) is installed in an identical manner, but oppositely oriented. Therefore, a detailed description of only one of the brushing heads is provided. Each brushing head has a tab (24*a*) extending downwardly therefrom and into the longitudinal opening (51) of the channel (50). The spring (49) projects directly into the tab and can be provided with or without a bend (49*a*) between the slanted wall (45 or 46) and the tab. During the manufacturing process, one end of the spring (49) is molded into the tab (24*a*). The other end of the spring is inserted through an opening in the respective slanted wall (45 or 46) and through the opening in the post (47). Once the brushing head is properly aligned and positioned in the base, the spring (49) is secured into the base (40). One important aspect of this embodiment is that the springs (49) are completely enclosed within the base (40) to prevent either the gum, cheek, or tongue from contacting the spring (40), thus protecting the user from being pinched by the spring (40).

In this third embodiment, during normal brushing, the two independent brushing heads articulate, within the limit surfaces, to the differing irregular surfaces encountered, including the side, inside and top and respective bottom areas of the individual teeth and adjacent gum. Accordingly, because the brushing heads pivotingly follow the contours of every surface of each tooth, the pivoting action provides a proper brushing angle for each tooth, the angle varying to follow the contours of the teeth and gum surfaces, including the inter-dental surfaces. Moreover, the "resting" angle and the "stopped" angle have been calculated to achieve an angle of attack which promote proper cleaning. As previously discussed, when the brushing heads are situated in the "resting" angle, the brushing heads behave like the fixed brushing heads. In other words, the high areas (26*a*, 27*b*) form the stabilizing contact areas which provide resting place for the brushing heads as previously discussed in detail.

The foregoing description is only illustrative of the principle of my invention. It is to be recognized and understood that the invention is not limited to the exact configuration as illustrated and described herein. Accordingly, all expedient modifications can be made within the scope and spirit of the invention.

I claim:

1. A toothbrush comprising:

an elongated handle including an elongated end portion and including a brushing bristle attaching means integral with one end of said elongated end portion, said elongated end portion generally defining an axis extending in the longitudinal direction of said handle;

a first brushing head connected to said attaching means and comprising first rows of brushing bristles having a distal end and a proximal end; and a second brushing head connected to said attaching means and comprising second rows of brushing bristles having a distal end and a proximal end, whereby the distal ends are situated further away from said handle along the longitudinal direction of the handle than the proximal ends, said first rows of bristles and said second rows of bristles are arranged side-by-side and inclined in the longitudinal direction at different angles relative to said axis so that said distal end of said first rows of brushing bristles is spaced further from said axis than said distal end of said second rows of brushing bristles and said proximal end of said first rows of brushing bristles is spaced closer to said axis than said proximal end of said second rows of brushing bristles.

2. A toothbrush comprising: an elongated handle including an elongated end portion and including a brushing bristle attaching means integral with one end of said elongated end portion, said elongated end portion generally defining an axis extending in the longitudinal direction of said handle;

a pair of discreet individual brushing heads each having brushing bristles mounted thereto, connected to said attaching means and each brushing head having a distal end and a proximal end, the distal ends being situated further away from said handle along the longitudinal direction of the handle than the proximal ends, whereby said pair of discreet heads are arranged side-by-side with said heads inclined in the longitudinal direction at different angles relative to said axis so that the proximal end of one of said pair of brushing heads is spaced further from said axis than the proximal end of the other brushing head and the distal end of said one brushing head is spaced closer to said axis than the distal end of said other brushing head.

3. A toothbrush comprising:

an elongated handle having an elongated end portion, said end portion generally defining an axis extending in the longitudinal direction of said handle;

brushing bristle attaching means integral with one end of said elongated end portion, said attaching means having a pair of side-by-side planar surfaces connected thereto, brushing bristles extending outwardly from said pair of planar surfaces, each planar surface being inclined relative to the longitudinal direction of said elongated handle, whereby each planar surface has a pair of ends, a distal end and a proximal end, the distal end being located further away from said handle in the longitudinal direction than the proximal end, said pair of planar surfaces being inclined in the longitudinal direction at different angles relative to said axis so that the proximal end of one planar surface is spaced further from said axis than the proximal end of the other planar surface and the distal end of said other planar surface is spaced further from said axis than the distal end of said one planar surface.

4. A toothbrush comprising:

an elongated handle having an elongated end portion, said end portion generally defining an axis extending in the longitudinal direction of said handle;

means for attaching brushing heads integral with one end of said elongated end portion; and a pair of discreet individual brushing heads each with brushing bristles formed thereon, connected to said attaching means, each individual brushing head having a planar surface in which said brushing bristles extend outwardly therefrom, each planar surface being inclined relative to the longitudinal direction of said elongated handle, whereby each planar surface has a pair of ends, a distal end and a proximal end, the distal end being located further away from said handle in the longitudinal direction than the proximal end, said pair of planar surfaces being inclined in the longitudinal direction at different directions relative to said axis so that the proximal end of one planar surface is spaced further from said axis than the proximal end of the other planar surface and the distal end of said other planar surface is spaced further from said axis than the distal end of said one planar surface when no pressure is exerted to said brushing heads.

5. A toothbrush according to claim 1, 2, or 4, wherein said brushing heads are integrally formed with said attaching means and said attaching means is integrally formed with said one end of said elongated end portion.

6. A toothbrush according to claim 3, wherein a pair of brushing heads forms said planar surfaces and said heads are integrally formed with said attaching means and said attaching means is integrally formed with said one end of said elongated end portion.

7. A toothbrush according to claim 3, wherein a pair of discreet individual brushing heads forms said planar surfaces, and said heads are attached to said attaching means.

8. A toothbrush according to claim 4 or 7, wherein each head flexes independently of the other head relative to said attaching means.

9. A toothbrush according to claim 8, wherein each head is articulated relative to said attaching means so as to allow movement of each head in a predetermined manner.

10. A toothbrush according to claim 9, wherein each head includes a biasing means to control the movement in said predetermined manner.

11. A toothbrush according to claim 10, wherein said biasing means is a spring wire extending from said attaching means into a tab extending from said head, said tab extending into a channel formed in said attaching means.

12. A toothbrush according to claim 11, wherein said channel comprises: a central opening bounded by two opposing sloping walls which face each other; a first longitudinal opening, bounded by two opposing walls which face each other, extending perpendicularly from one end of said central opening; and a second longitudinal opening, bounded by two opposing walls, extending perpendicularly from the other end of said central opening and extending in the opposite direction to said first longitudinal opening, said spring wires extend from said sloping walls of said central opening.

13. A toothbrush according to claim 9, wherein said movement of each bead is limited by two adjoining stop surfaces formed on said attaching means, which form an oblique angle.

14. A toothbrush according to claim 13, wherein each head includes a spring wire operatively connected to said attaching means to control said articulating movement of said head.

15. A toothbrush according to claim 14, wherein each spring wire biases each head to one of said two stop surfaces when no external force is applied to said head.

16. A toothbrush according to claim 4 or 7, wherein said elongated handle includes an offset portion which is angled relative to said elongated end portion.

17. A toothbrush according to claim 4 or 7, wherein said elongated portion flexes when pressure is applied to said bristles during brushing.

18. A toothbrush according to claim 4 or 7, wherein said brushing bristles formed at said proximal end of said one planar surface and said brushing bristles formed at said distal end of said other planar surface form respective high areas of the angled brushing heads, said respective high areas providing two stabilizing contact areas.

19. A toothbrush according to claim 4 or 7, wherein each brushing head is angled at a predetermined angle relative to the handle.

20. A toothbrush according to claim 8, wherein each head includes a biasing means to permit the flexing of said head.

* * * * *